United States Patent [19]

Lawrence et al.

[11] Patent Number: 4,721,210

[45] Date of Patent: Jan. 26, 1988

[54] TAMPER-EVIDENT PACKAGE

[76] Inventors: Richard R. Lawrence, 39 Manchonis, Wilbraham, Mass. 01095; Charles R. Malsbury, R.F.D. #1, Palmer, Mass. 01069; Glenn Moreau, 27 Amherst St., Granby, Mass. 01033

[21] Appl. No.: 931,837

[22] Filed: Nov. 18, 1986

[51] Int. Cl.[4] ..... B65D 41/48; B65D 41/62

[52] U.S. Cl. ..... 206/459; 206/807; 215/254; 215/320; 220/306; 220/266; 53/487; 53/423

[58] Field of Search ..... 206/459, 807; 220/306, 220/266, 268; 215/320, 254, 31, 253; 53/487, 489, 423

[56] References Cited

U.S. PATENT DOCUMENTS

| | | | |
|---|---|---|---|
| 2,032,521 | 3/1936 | Barton . | |
| 3,301,459 | 1/1967 | Gardner | 220/306 |
| 3,405,830 | 10/1968 | Hayashida | 215/320 |
| 3,421,681 | 1/1969 | Frank | 215/254 |
| 3,815,770 | 6/1974 | Guala | 215/31 |
| 3,866,783 | 2/1975 | Bullock et al. | 215/254 |
| 3,967,731 | 7/1976 | Boduch . | |
| 4,006,839 | 2/1977 | Thiel et al. . | |
| 4,026,459 | 5/1977 | Blanchard | 220/306 |
| 4,090,660 | 5/1978 | Schram et al. | 220/306 |
| 4,217,989 | 8/1978 | George . | |
| 4,354,610 | 10/1982 | Kessler et al. . | |
| 4,387,818 | 6/1983 | Conti | 215/31 |
| 4,474,305 | 10/1984 | Marco . | |
| 4,483,450 | 11/1984 | Sanchez | 215/254 |
| 4,488,658 | 12/1984 | Smith et al. . | |
| 4,522,308 | 6/1985 | Sullivan | 215/254 |

FOREIGN PATENT DOCUMENTS

| | | | |
|---|---|---|---|
| 1150194 | 7/1983 | Canada | 215/254 |
| 2091706 | 8/1982 | United Kingdom | 220/306 |

*Primary Examiner*—Stephen Marcus
*Assistant Examiner*—Brenda J. Ehrhardt
*Attorney, Agent, or Firm*—Pennie & Edmonds

[57] ABSTRACT

A lid and cup assembly for storing and dispensing comestibles is disclosed which provides a tamper-evident package to indicate unauthorized tampering. The tamper-evident package for storing and dispensing comestibles and the like, includes a cup formed of a sidewall member having at its open end a rim with an unrolled peripheral edge. The package also includes a lid configured and dimensioned for engagement with the cup at its open end. The lid includes a panel member having along its periphery an annular rib configured and dimensioned so as to snap-fittingly and sealingly engage the cup. The annular rib is formed of an inner wall an outer wall and a transverse top wall. The outer wall has three spaced apart detent ribs of predetermined length for securing engagement with the cup peripheral edge at least when the lid is pried off. The outer wall also has adjacent at least one of the detent ribs a pair of tear lines on each side of the respective detent rib. The top wall has a hinge groove therealong engaging the rim of the cup so as to provide a pressure and a vacuum seal and so that when the outer wall member is pulled outwardly away from engagement with the cup peripheral edge, at least a portion of the outer wall breaks from the remaining portion at least at the tear lines and hinges about the groove while the pressure and said vacuum seal engagement remains intact to provide evidence of unauthorized tampering.

A method for forming the tamper-evident package is also disclosed.

52 Claims, 6 Drawing Figures

TAMPER-EVIDENT PACKAGE

TECHNICAL FIELD

The present invention relates to a package for comestibles and the like. In particular, the present invention relates to a lid which together with a cup for comestibles provides a tamper-evident package which indicates any unauthorized tampering.

BACKGROUND ART

Comestibles such as cottage cheese, sour cream, cream cheese dips and the like are typically packaged in cup-like containers having closures or lids made of relatively resilient materials. Closures or lids for such container cups are depressed inwardly relative to the top of the lip and are relatively flexible in construction to provide for ease of handling by the consumer. Such lids, however, when handled during inspection present difficulties if the lid is easily capable of being opened and closed without providing proof of unauthorized entry.

Typically, a customer may on occasion remove the lid in order to examine the contents or the comestible therein. If the customer is satisfied and purchases the comestible then there is no problem since there has been no unauthorized tampering and the customer would be expected to utilize the comestible at the customer's convenience. However, in the event that the customer is not interested in purchasing the comestible, the lid may be returned and the package replaced upon the shelf. In such instance, spoilage can occur while the comestible is sitting on the shelf awaiting future purchase.

In addition, if a person introduces foreign objects or possibly toxic contaminants it is highly desirable to provide to a future customer evidence of tampering. If the lid can be easily removed, the toxic substance introduced and lid thereupon repositioned atop the container without any indication that tampering has occurred, the customer is unaware of any tampering. In order to avoid this problem, it has been suggested that the entire package be enveloped in a plastic wrap which could not be removed without providing a sure proof indication of entry and possible unauthorized for entry tampering.

Although such improvement is available with the plastic wrap, it is also desirable to provide tamper-evident proof without the need to resort to the use of a plastic wrap. For this reason, various suggestions have been put forth to provide for tamper-evident rings around the periphery of the lid. Such rings require that before use the customer completely remove the ring before the lid can be withdrawn from the container mouth.

However, even with typical ring type lids such ring lid structures can still be pried off from the container mouth without any breakage of the ring. There would therefore be no evidence of tampering upon the repositioning of the ring and lid structure onto the container. Moreover, such ring-type structures in many instances are complicated and this also increases the cost and expense of manufacture and assembly which lessen the desirability of such ring-type structures.

We have invented a lid which avoids the aforementioned problems and provides proof of any unauthorized tampering while maintaining the contents in a sealed condition.

SUMMARY OF THE INVENTION

The present invention relates to a tamper-evident package for storing and dispensing comestibles and the like, comprising a cup formed of a sidewall member having at its open end a rim with an unrolled peripheral edge, and a lid configured and dimensioned for engagement with the cup at its open end such that when the lid is snapped onto the cup over the open end, the lid includes a panel member having along its periphery an annular rib configured and dimensioned so as to snap-fittingly and sealingly engage with the cup at its open end, the annular rib formed of an inner wall member, an outer wall member having at least two spaced apart detent ribs of predetermined length for securing engagement with the cup peripheral edge at least when the lid is pried off, and a top wall member joining the inner and outer wall members, the outer wall member having adjacent at least one of the detent ribs a pair of tear lines disposed with the respective detent rib being between the pair of tear lines so that when the lid is pried to disengage at least one of the detent ribs, at least one of the tear lines is broken, the top wall having a hinge groove therealong engaging the rim of the cup so as to provide a pressure and a vacuum seal and so that when the outer wall member is pulled outwardly away from engagement with the cup peripheral edge, at least a portion of the outer wall breaks from the remaining portion at least at the tear lines and hinges about the groove while the pressure and the vacuum seal engagement remains intact to provide evidence of unauthorized tampering.

Preferably the outer wall comprises a plurality of equally spaced apart detent ribs and the detent ribs extend toward the inner wall and circumferentially along the outer wall. The package further comprises a plurality of retention ribs each of a predetermined length and equal in number to the plurality of detent ribs. Each retention rib is disposed between respective adjacent detent ribs for engagement with the peripheral edge of the cup when the lid is pried off. Also the retention ribs are of a greater predetermined length than the detent ribs and extend toward the inner wall and circumferentially along the outer wall. The retention ribs preferably extend less toward the inner wall than the detent ribs extend.

According to one preferred embodiment, the package further comprises a tear line disposed adjacent along the length of at least one of the retention ribs so that the retention rib tear line when broken can provide evidence of unauthorized tampering. Preferably the panel member lies below the sealing ridge of the cup. Also the panel member and annular rib are each generally of a circular configuration and are integrally formed. The lid can be of a nonuniform thickness while the sidewall member can be of a frustoconical configuration and is integrally formed with the rim.

In a preferred embodiment, the cup and lid are each thermoformed of an organopolymetric material such as high impact polysterene. Alternatively, the lid can be thermoformed of styrene butidene. The lid can be formed of a predetermined color and preferably a color different from that of the cup.

In an alternative preferred embodiment of the present invention, the tamper-evident package for storing and dispensing comestibles and the like, comprises a cup formed of a sidewall member and a bottom wall member secured to one end of the sidewall member, the sidewall member having at its open end a rim with an unrolled peripheral edge and a sealing ridge disposed in the sidewall member, and a lid configured and dimensioned for engagement with the cup at its open end such that when the lid is snapped onto the cup over the open end, the lid includes a panel member having along its periphery an annular rib configured and dimensioned so as to snap-fittingly and sealingly engage with the cup at its open end, the annular rib formed of an inner wall member engaging the sealing ridge of the cup so as to provide pressure seal engagement, an outer wall member having three equally spaced apart elongated detent ribs of equal predetermined length for securing engagement with the cup peripheral edge at least when the lid is pried off, and a top wall member joining the inner and outer wall members, the outer wall member having adjacent each of the detent ribs a pair of tear lines disposed with the respective detent rib being between the pair of tear lines so that when the lid is pried to disengage at least one of the detent ribs, at least one of the respective tear lines is broken, the top wall having a hinge groove therealong engaging the rim of the cup so as to provide at least a vacuum seal and so that when the outer wall member is pulled outwardly away from engagement with the cup peripheral edge, at least a portion of the outer wall breaks from the remaining portion at least at the tear lines and hinges about the groove while the vacuum seal engagement remains intact to provide evidence of unauthorized tampering.

Preferably, the detent ribs extend toward the inner wall and circumferentially along the outer wall. The package further comprises three equally spaced apart elongated retention ribs each of equal predetermined length. Each retention rib is disposed between respective adjacent detent ribs for engagement with the peripheral edge of the cup when the lid is pried off. Also the retention ribs are of a greater predetermined length than the detent ribs and extend toward the inner wall and circumferentially along the outer wall. The retention ribs preferably extend less toward the inner wall than the detent ribs extend.

In one preferred embodiment, the package further comprises a tear line disposed approximately adjacent along the middle portion of each retention rib so that the retention rib tear line when broken can provide evidence of unauthorized tampering.

The present invention also relates to a tamper-evident lid as described above and a method of forming a tamper-evident package of the present invention.

BRIEF DESCRIPTION OF THE DRAWINGS

The present invention is described in detail below with reference to the drawings in which.

DESCRIPTION OF THE PREFERRED EMBODIMENTS

In the description which follows, any reference to either direction or orientation is intended primarily and solely for purposes of illustration and is not intended in any way as a limitation of the scope of the present invention. Also, the particular embodiments described herein, although being preferred, are not to be considered as limiting of the present invention. Furthermore, like parts or elements in the various drawings hereto are identified by like numerals for ease of reference.

Figure 1:
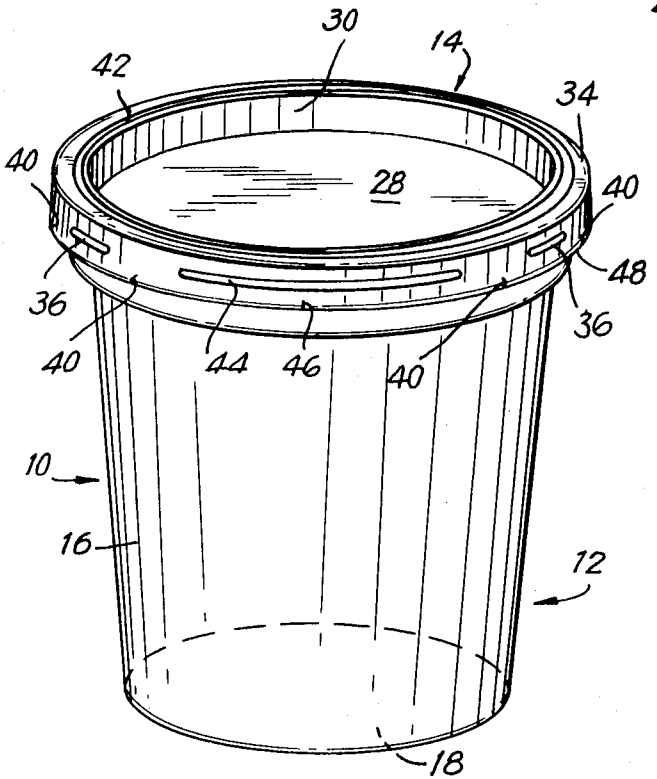
FIG. 1 is a perspective view of a tamper-evident lid-cup container according to the present invention.
Figure 4:
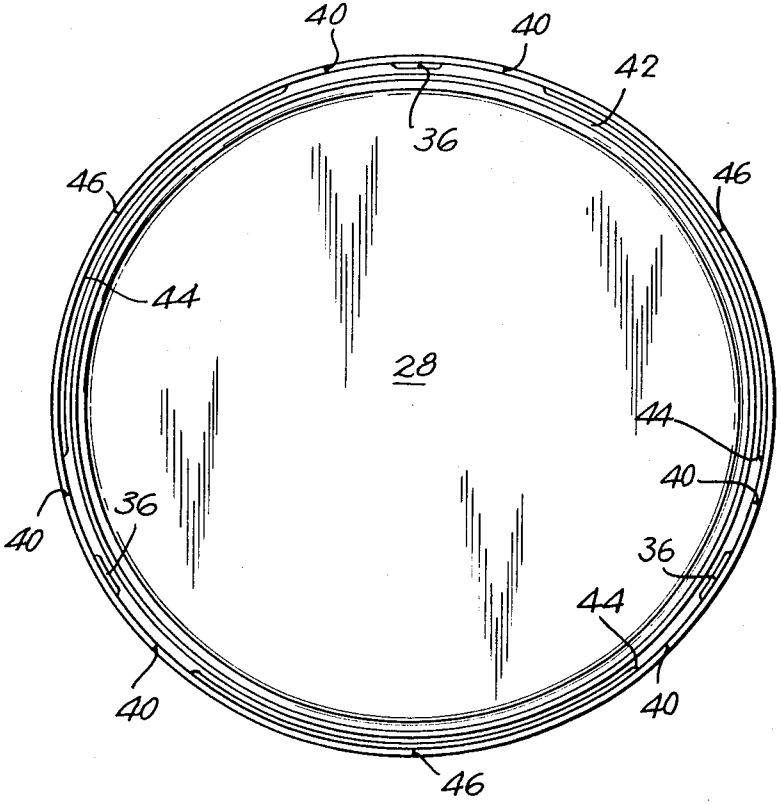
FIG. 4 is a bottom view of the sealing lid of FIG. 1.
Figure 3:
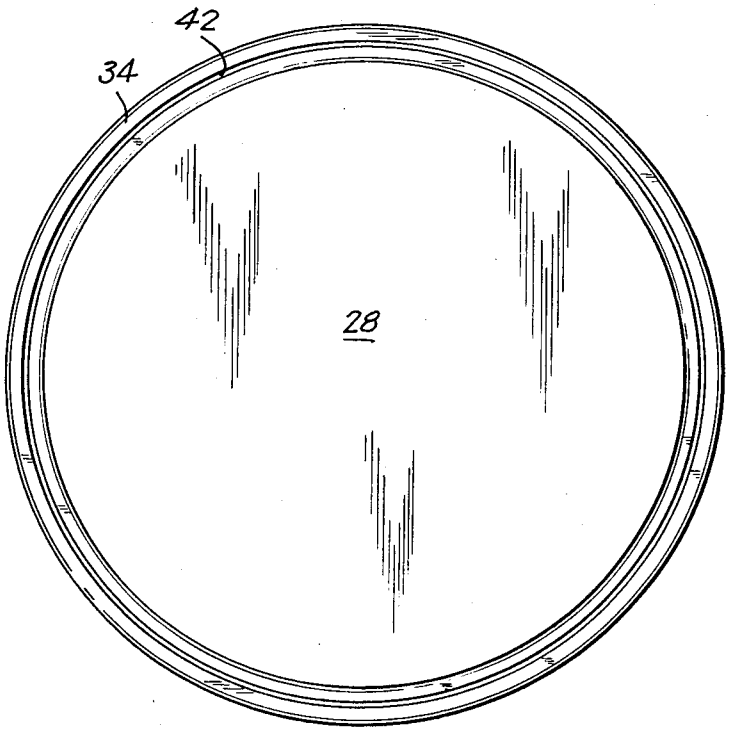
FIG. 3 is a top view of the sealing lid of FIG. 1.

Referring to the drawings, a package 10 for comestibles according to the present invention is shown in FIG. 1. The package 10 includes a cup 12 and sealing lid 14 which is positioned over the wide mouth opening of cup 12. The cup 12 is of a cylindrical configuration which provides for internal sealing of the comestible therein. As illustrated in FIG. 1, the cup includes a frusto-conically shaped sidewall 16 and a bottom wall 18. At its upper or open end, the cup 12 provides a wide mouth opening through which the comestible can be passed for packaging and also during removal.

For ease of further discussion herein, it should be noted that the package 10 is symmetrical about its vertical axis denoted by the letters "X-X" in FIG. 1, wherefor, any description of a portion of the package 10 on either side of this axis line provides adequate description of the corresponding mirror image portion on the other side of the vertical axis X-X. For this reason, it is to be understood that any description of the structure of package 10 in cross-section is deemed sufficient for complete description since simply by rotating such cross section about the vertical axis X-X would in fact provide for the entire structure of the package 10.

Figure 5:
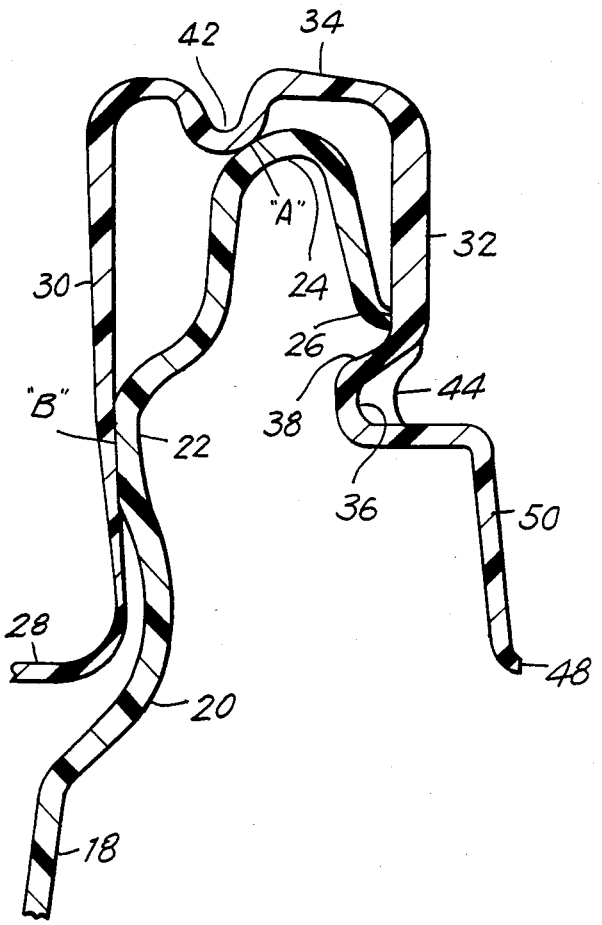
FIG. 5 is an enlarged, cross-sectional view of the lid snap-fittingly and sealingly engaged with the cup taken along the line 5-5 of FIG. 1.

As shown more clearly in FIG. 5, a preferred embodiment of the sidewall 16 includes a lower frusto-conical wall section 18 which rises to elbow 20 and thereafter extends as sealing ridge 22, U-shaped rim 24 and peripheral edge 26. Preferably the cup 12 is integrally formed. Unlike conventional cups, the rim 24 of cup 12 according to the present invention is unrolled.

Figure 2:
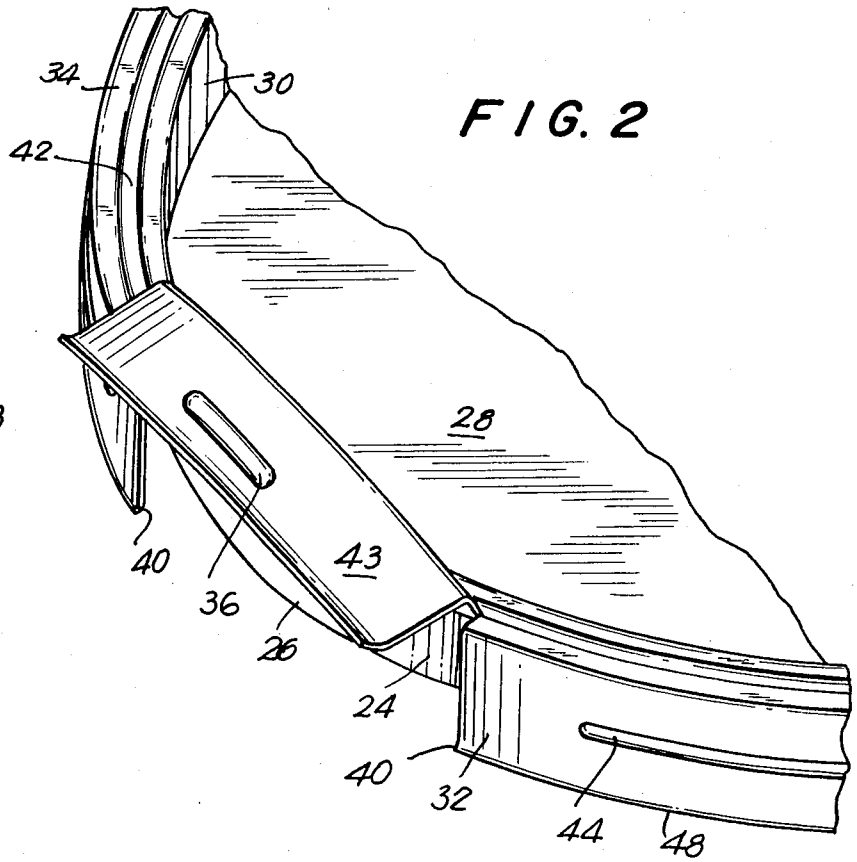
FIG. 2 is an enlarged partial view of the tamper-evident lid of FIG. 1 illustrating an indication of tampering.

Sealing lid 14, as shown in FIGS. 1 and 2, includes a centrally positioned circular flat panel member 28 having along its periphery an annular rib formed of an upwardly extending inner wall 30, an outer wall 32 generally parallel to inner wall 30 and a top wall 34 which transversely joins the inner and outer walls 30, 32. As shown in FIG. 1, the outer wall 32 has a plurality of elongated spaced apart, preferably three, detent ribs 36 of a predetermined length which as shown in FIG. 5 are positioned below the peripheral edge 26 of cup 12. The detent ribs 36 extend toward the inner wall 30 and also extend in a circumferential direction along the outer wall 32. However, when the lid 14 is pried off the cup 12, at least then the detent ribs 36 by means of upper shoulder 38 engage peripheral edge 26 to provide for retention of the lid upon the cup 12. Also at least one and preferaably all of the detent ribs 36 has a pair of tear lines or slits 40 which extend vertically with relation to the respective detent rib 36 positioned between the pair of tear lines 40. In this manner, when the lid 14 is pried to disengage at least one of the detent ribs 36, at least one of the tear lines 40 is broken which thereupon provides indication of unauthorized tampering or attempts at removing the lid 14 from the cup 12.

Figure 6:
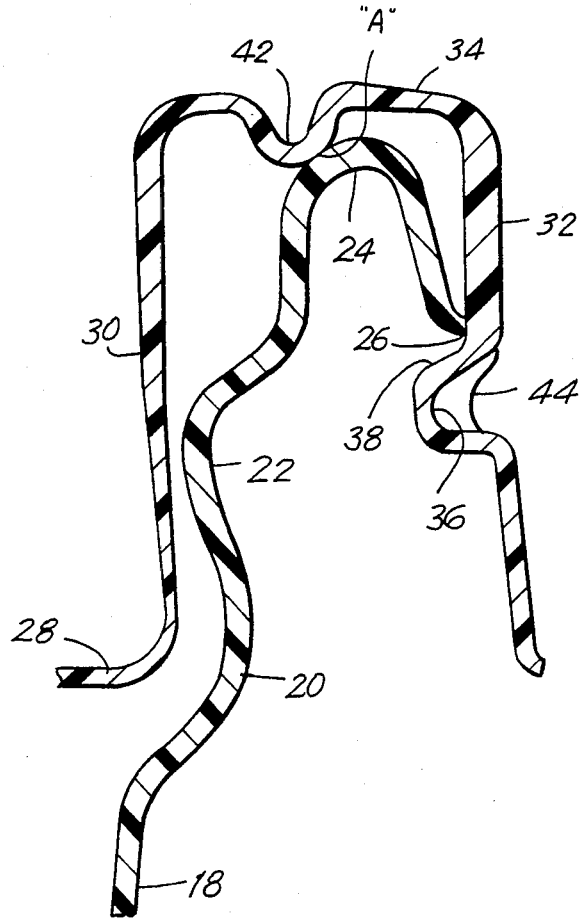
FIG. 6 is an enlarged cross-sectional view of an alternative embodiment of the lid and cup of FIG. 5.

The top wall 34 has a hinge groove 42 positioned midway and circumferentially along the entire length of the top wall 34. The hinge groove engages against the rim 24 to provide at least a vacuum seal and also a pressure seal in the region indicated as "A". For this reason, the annular rib of lid 14 is dimensioned and configured so that the U-shaped rim 24 and the peripheral edge 26 of the cup 12 are snap fittingly engaged as shown in FIG. 5 at least against the hinge groove 42 and the inner surface of outer wall 32, respectively, in a snap fitting and sealing engagement. In addition, according to the embodiment illustrated in FIG. 5, the inner wall 30 is dimensioned and configured so as to engage against the sealing ridge 22 and thereby provide additional pressure engagement if desired at the region indicated as "B". However, in the alternative embodiment of the lid 14 shown in FIG. 6, the inner wall 30 is dimensioned so as to permit it to be clear of sealing ridge 22 whereupon there is no engagement therebetween. In the latter instance, the pressure and sealing engagement is provided between the U-shaped rim 24 and the hinge groove 42 as described above.

Thus, when the lid 14 is pried from the container 12, at least a portion 43 of the outer wall 32 such as that between tear lines 40 as shown in FIG. 2 can break away from the remaining portion of outer wall 32 and hinge about hinge groove 42 while the pressure and vacuum seal engagement provided between hinge groove 42 and rim 24 is maintained intact. However, the broken portion 43 of outer wall 32 provides clear evidence of unauthorized tampering. Nonetheless, the vacuum and pressure seal at "A" is maintained and thereby preserves the integrity of the contents within the container 12. Additionally, the integrity of the pressure seal at "B" of the embodiment illustrated in FIG. 5 is also maintained while the broken portion 43 indicates tampering.

Preferably, the lid 14 also includes a plurality of elongated retention ribs 44 which are of like number, preferably three, to that of the detent ribs 36. A retention rib is positioned between a pair of adjacent or successive detent ribs 26 as shown in FIG. 1. Like the detent ribs 36, the retention ribs 44 also are positioned as shown in FIG. 5 to engage the peripheral edge 26 at least when the lid 14 is pried from the container 12. Alternatively, the lid outer wall 32 can be configured so that the peripheral edge 26 directly engages against the upper shoulder 38 and also that (not shown) of retention rib 44. However in the embodiment illustrated in FIG. 5, it is sufficient that the peripheral edge engages at least at some portion of the inner surface of outer wall 32 which may be above the shoulder 38. In the embodiment illustrated in FIG. 1, the retention ribs 44 are of a greater predetermined length than the detent ribs 36 and like the latter 36 also extend toward the inner wall 30 but to a lesser extent than that to which the detent ribs 36 extend. Also, the retention ribs 44 extend circumferentially along the outer wall 32. In order to provide further indication of tampering, a slit line 46 is positioned adjacent below the midportion of the retention rib 44 as shown in FIG. 1. Accordingly, evidence of tampering can be provided upon the tearing of any of slits 40 or 46. If desired, additional slits can be provided at predetermined positions along the circumferential edge 48 of outer wall 32.

In the embodiment illustrated in FIG. 1, the panel member 28 preferably is positioned below the sealing ridge 22 of cup 12. In addition, the panel member 28 and annular rib which includes walls 30, 32 and 34 are each generally of a circular configuration and are integrally formed. Although various portions of the lid 14 are indicated as illustrated as being of a uniform thickness, certain portions such as the juncture of panel 28 and outer wall 30 may be of a smaller thickness in order to accommodate flexibility and provide greater resilience. Alternatively, the lid 14 can be of a non-uniformed thickness as desired. In addition, the outer wall 32 as shown in FIG. 5 can have a lower portion 50 which is positioned outwardly of the upper portion of outer wall 32. In the alternative embodiment shown in FIG. 6, the outer wall 32 is generally continuous but for the detent ribs 36 and retention ribs 44.

The lid 14 of the present invention thus provides the sealing necessary to accomodate both pressure and vacuum forces as well as to permit nestable stacking of a plurality of like lids 14 upon one another for ease of handling in automated packing apparatus—commonly termed coin-fed—as well as to economize on the utilization of storage space. Additionally, the lid 14 provides clear and ready evidence that tampering may have occurred while still maintaining the contents of cup 12 in a sealed condition.

In accordance with the invention, organopolymetric materials are utilized in the manufacture of the lids 14 and cups 12. In this regard, suitable organopolymetric materials permit thermoforming of the lids 14 and cups 12. Organopolymetric materials have been found to be particularly suitable materials for manufacture of lids 14 and cups 12 in accordance with the present invention, and are particularly preferred herein. In one preferred embodiment the cup 12 and lid 14 are each integrally thermoformed of high impact polystyrene. Alternatively, the lid 14 in another preferred embodiment can be thermoformed of styrene butidene. As noted, the organopolymetric lids 14 which are relatively or generally rigid are circular or disc shaped and are suitably wide for snapping frictional and sealing engagement with a relatively large circular mouthed frustoconical cup 12.

Although the cup 12 and lid 14 are typically formed of an opaque material, the lid 14 can alternatively be made transparent to permit viewing of the contents. If desired, the cup 12 can also be made transparent for viewing purposes as well. In addition, the cup 12 and lid 14 can be imprinted on their outer surfaces to provide useful information to the consumer at predetermined locations. Such information includes identification of contents, manufacturer and the like. Also, graduations (not shown) can be provided on the outside of the cup 12. Such graduations 62 are particularly useful when the cup 12 is transparent so as to indicate the volume of the contents.

Moreover, the lid 14 can be theroformed of a predetermined color which preferably would be different from that of the cup in order to provide ready indication to the customer of the tamper-evident capability of the lid 14 and cup 12 of the present invention. In this fashion, the customer would be readily drawn to the tamper-evident package of the present invention as compared to other package containers that do not provide tamper-evident indication.

After the cup 12 is filled, for example, with a comestible such as cottage cheese, and the lid 14 is snap fitted and sealing engaged upon the cup 12, the comestible is sealed and is maintained in that condition until time of use. The lid 14 is structured so that any unauthorized entry into the cup 12 would require that at least a portion of the outer wall 32 is broken in at least one tear line portion 40 or 46. Any additional attempt to remove the lid 14 would provide that at least a portion 43 of the outer wall 32 such as that shown on FIG. 2 is broken away from the remaining outer wall 32. Only by additional breakage of yet other tear lines 40 or 46 or of portions of the outer wall 32 could the lid 14 be completely removed from the cup 12 in order to permit entry therein. In this manner, the lid 14 of the present invention can be utilized with a cup 12 without the further need for seal wraps and the like and yet still provide a tamper-evident package which provides ready indication that tampering may have occurred.

While the present invention has been described and illustrated herein with respect to a preferred embodiment thereof, it should be apparent that various modifications, adaptations and variations may be made utilizing the teachings of the present disclosure without departing from the scope of the invention, and are intended to be within the scope of the present invention.

We claim:

1. Tamper-evident package for storing and dispensing comestibles and the like, comprising:

a. cup formed of a sidewall member having at its open end a rim with an unrolled peripheral edge; and b. lid configured and dimensioned for engagement with said cup at its open end such that when said lid is snapped onto the cup over said open end, said lid includes a panel member having along its periphery an annular rib configured and dimensioned so as to snap-fittingly and sealingly engage with said cup at its open end, said annular rib formed of an inner wall member, an outer wall member having at least two spaced apart detent ribs of predetermined length for securing engagement with said cup peripheral edge at least when said lid is pried off, and a top wall member joining said inner and outer wall members, said outer wall member having adjacent at least one of said detent ribs a pair of tear lines disposed with said respective detent rib being between said pair of tear lines so that when said lid is pried to disengage at least one of said detent ribs, at least one of said tear lines is broken, said top wall having a hinge groove therealong engaging said rim of said cup so as to provide a pressure and a vacuum seal and so that when said outer wall member is pulled outwardly away from engagement with said cup peripheral edge, at least a portion of said outer wall breaks from the remaining portion at least at said tear lines and hinges about said groove while said pressure and said vacuum seal engagement remains intact to provide evidence of unauthorized tampering.

2. The package according to claim 1 wherein said outer wall comprises a plurality of equally spaced apart detent ribs.

3. The package according to claim 2 wherein said detent ribs extend toward said inner wall and circumferentially along said outer wall.

4. The package according to claim 3 further comprising a plurality of retention ribs each of a predetermined length and equal in number to said plurality of detent ribs, each retention rib being disposed between respective adjacent detent ribs for engagement with said peripheral edge of said cup when said lid is pried off.

5. The package according to claim 4 wherein said retention ribs are of a greater predetermined length than said detent ribs and extend toward said inner wall and circumferentially along said outer wall.

6. The package according to claim 5 wherein said retention ribs extend less toward said inner wall than said detent ribs extend.

7. The package according to claim 6 further comprising a tear line disposed adjacent along the length of at least one of said retention ribs so that said retention rib tear line when broken can provide evidence of unauthorized tampering.

8. The package according to claim 7 wherein said panel member lies below said sealing ridge of said cup.

9. The package according to claim 8 wherein said panel member and annular rib are each generally of a circular configuration.

10. The package according to claim 9 wherein said panel member and annular rib are integrally formed.

11. The package according to claim 10 wherein said lid is of a nonuniform thickness.

12. The package according to claim 11 wherein said sidewall member is of a frustoconical configuration.

13. The package according to claim 12 wherein said rim is integrally formed with said sidewall member.

14. The package according to claim 13 wherein said cup and lid are each thermoformed of an organopolymetric material.

15. The package according to claim 14 wherein said organopolymetric material is preferably high impact polysterene.

16. The package according to claim 15 wherein said cup is thermoformed of high impact polysterene and said lid is thermoformed of styrene butidene.

17. The package according to claim 16 wherein said lid is formed of a predetermined color.

18. The package according to claim 17 wherein said lid is colored differently from said cup.

19. Tamper-evident package for storing and dispensing comestibles and the like, comprising:

a. cup formed of a sidewall member and a bottom wall member secured to one end of said sidewall member, said sidewall member having at its open end a rim with an unrolled peripheral edge and a sealing ridge disposed in said sidewall member; and b. lid configured and dimensioned for engagement with said cup at its open end such that when said lid is snapped onto the cup over said open end, said lid includes a panel member having along its periphery an annular rib configured and dimensioned so as to snap-fittingly and sealingly engage with said cup at its open end, said annular rib formed of an inner wall member engaging said sealing ridge of said cup so as to provide pressure seal engagement, an outer wall member having three equally spaced apart elongated detent ribs of equal predetermined length for securing engagement with said cup peripheral edge at least when said lid is pried off, and a top wall member joining said inner and outer wall members, said outer wall member having adjacent each of said detent ribs a pair of tear lines disposed with said respective detent rib being between said pair of tear lines so that when said lid is pried to disengage at least one of said detent ribs, at least one of said respective tear lines is broken, said top wall having a hinge groove therealong engaging said rim of said cup so as to provide at least a vacuum seal and so that when said outer wall member is pulled outwardly away from engagement with said cup peripheral edge, at least a portion of said outer wall breaks from the remaining portion at least at said tear lines and hinges about said groove while said vacuum seal engagement remains intact to provide evidence of unauthorized tampering.

20. The package according to claim 19 wherein said detent ribs extend toward said inner wall and circumferentially along said outer wall.

21. The package according to claim 20 further comprising three equally spaced apart elongated retention ribs each of equal predetermined length, each retention rib being disposed between respective adjacent detent ribs for engagement with said peripheral edge of said cup when said lid is pried off.

22. The package according to claim 21 wherein said retention ribs are of a greater predetermined length than said detent ribs and extend toward said inner wall and circumferentially along said outer wall.

23. The package according to claim 22 wherein said retention ribs extend less toward said inner wall than said detent ribs extend.

24. The package according to claim 23 further comprising a tear line disposed approximately adjacent the middle portion of each retention rib so that said retention rib tear line when broken can provide evidence of unauthorized tampering.

25. The package according to claim 24 wherein said panel member lies below said sealing ridge of said cup.

26. The package according to claim 25 wherein said panel member and annular rib are each generally of a circular configuration.

27. The package according to claim 26 wherein said panel member and annular rib are integrally formed.

28. The package according to claim 27 wherein said lid is of a nonuniform thickness.

29. The package according to claim 28 wherein said sidewall member is of a frustoconical configuration.

30. The package according to claim 29 wherein said bottom wall member is integrally formed with said sidewall member.

31. The package according to claim 30 wherein said cup and lid are each thermoformed of an organopolymetric material.

32. The package according to claim 31 wherein said organopolymetric material is preferably high impact polysterene.

33. The package according to claim 32 wherein said cup is thermoformed of high impact polysterene and said lid is thermoformed of styrene butidene.

34. The package according to claim 33 wherein said lid is formed of a predetermined color.

35. The package according to claim 34 wherein said lid is colored differently from said cup.

36. A tamper-evident lid for a cup formed of a sidewall member and a bottom wall member secured to one end of the sidewall member for storing and dispensing comestibles and the like, the sidewall member having at its open end a rim with an unrolled peripheral edge and a sealing ridge disposed in the sidewall member, said lid comprising being configured and dimensioned for engagement with said cup at its other end such that when said lid is snapped onto the cup over said open end, said lid includes:

a. a panel member having a periphery;

b. an annular rib disposed along said periphery of said panel member and being configured and dimensioned so as to snap-fittingly and sealingly engage with said cup at its open end, said annular rib formed of:

i. an inner wall member engaging said sealing ridge of said cup so as to provide pressure seal engagement;

ii. an outer wall member having at least two spaced apart detent ribs of predetermined length for securing engagement with said cup peripheral edge at least when said lid is pried off, said outer wall member having adjacent each of said detent ribs a pair of tear lines disposed with said respective detent rib being between said pair of tear lines so that when said lid is pried to disengage at least one of said detent ribs, at least one of said respective tear lines is broken;

iii. a top wall member joining said inner and outer wall members and having a hinge groove therealong engaging said rim of said cup so as to provide at least a vacuum seal and so that when said outer wall member is pulled outwardly away from engagement with said cup peripheral edge, at least a portion of said outer wall breaks from the remaining portion at least at said tear lines and hinges about said groove while said vacuum seal engagement remains intact to provide evidence of unauthorized tampering.

37. The lid according to claim 36 wherein said outer wall comprises a plurality of equally spaced apart detent ribs extending toward said inner wall and circumferentially along said outer wall.

38. The lid according to claim 37 further comprising a plurality of retention ribs each of equal predetermined length and equal in number to said plurality of detent ribs, each retention rib being disposed between respective adjacent detent ribs for engagement with said peripheral edge of said cup when said lid is pried off, each retention rib being of a greater predetermined length than said detent ribs and extending toward said inner wall and circumferentially along said outer wall.

39. The lid according to claim 38 wherein said retention ribs extend less toward said inner wall than said detent ribs extend.

40. The lid according to claim 39 further comprising a tear line disposed approximately adjacent along the middle portion of each retention rib so that said retention rib tear line when broken can provide evidence of unauthorized tampering.

41. The lid according to claim 40 wherein said panel member lies below said sealing ridge of said cup.

42. The lid according to claim 41 wherein said panel member and annular rib are each generally of a circular configuration and are integrally formed.

43. The lid according to claim 42 wherein said annular rib is of a nonuniform thickness.

44. The lid according to claim 43 wherein said panel member and annular rib are each thermoformed of an organopolymetric material.

45. The lid according to claim 44 wherein said organopolymetric material is preferably high impact polysterene.

46. The lid according to claim 45 wherein said panel member and annular rib are thermoformed of styrene butidene.

47. The package according to claim 46 wherein said panel member and annular rib are formed of a predetermined color.

48. The package according to claim 47 wherein said panel member and annular rib are colored differently from said cup.

49. Method of forming a tamper-evident package for storing and dispensing comestibles and the like, comprising:

a. forming a cup of a sidewall member having at its open end a rim with an unrolled peripheral edge; and b. forming a lid configured and dimensioned for engagement with said cup at its open end such that when said lid is snapped onto the cup over said open end, said lid includes a panel member having along its periphery an annular rib configured and dimensioned so as to snap-fittingly and sealingly engage with said cup at its open end, forming said annular rib of an inner wall member, an outer wall member having at least two spaced apart detent ribs of predetermined length for securing engagement with said cup peripheral edge at least when said lid is pried off, and a top wall member joining said inner and outer wall members, said outer wall member having adjacent at least one of said detent ribs a pair of tear lines disposed with said respective detent rib being between said pair of tear lines so that when said lid is pried to disengage at least one of said detent ribs, at least one of said respective tear lines is broken, said top wall having a hinge groove therealong engaging said rim of said cup so as to provide a pressure and a vacuum seal and so that when said outer wall member is pulled outwardly away from engagement with said cup peripheral edge, at least a portion of said outer wall breaks from the remaining portion at least at said tear lines and hinges about said groove while said pressure and vacuum seal engagement remains intact to provide evidence of unauthorized tampering.

50. The method according to claim 49 further comprising forming a sealing ridge disposed in said sidewall member such that when said lid is snapped onto said cup over said open end, said inner wall member engages said sealing ridge so as to provide a pressure seal engagement.

51. The method according to claim 50 further comprising forming a tear line adjacent along the length of at least one of said retention ribs so that said retention rib tear line when broken can provide evidence of unauthorized tampering.

52. The method according to claim 51 further including filling said cup with the comestible.

* * * * *